US006764429B1

(12) United States Patent
Michalow

(10) Patent No.: US 6,764,429 B1
(45) Date of Patent: Jul. 20, 2004

(54) RUN SPECIFIC TRAINING APPARATUS

(75) Inventor: Alex Michalow, Bourbonnais, IL (US)

(73) Assignee: Acinonyx Company, Bourbonnais, IL (US)

( * ) Notice: Subject to any disclaimer, the term of this patent is extended or adjusted under 35 U.S.C. 154(b) by 135 days.

(21) Appl. No.: 10/277,074

(22) Filed: Oct. 21, 2002

Related U.S. Application Data

(62) Division of application No. 09/435,220, filed on Nov. 5, 1999, now Pat. No. 6,482,128.
(60) Provisional application No. 60/107,672, filed on Nov. 6, 1998.

(51) Int. Cl.[7] ..... A63B 23/04; A63B 21/008; A63B 21/062; A63B 21/065

(52) U.S. Cl. ..... 482/51; 482/54; 482/100; 482/105; 482/112; 482/137; 482/138

(58) Field of Search ..... 482/99–103, 111–113, 482/133–138, 105, 51–54

(56) References Cited

U.S. PATENT DOCUMENTS

| | | | | |
|---|---|---|---|---|
| 3,501,140 A | * | 3/1970 | Eichorn | 482/130 |
| 3,751,031 A | | 8/1973 | Yamauchi | |
| 3,834,696 A | | 9/1974 | Spector | |
| 3,912,265 A | | 10/1975 | Muir | |
| 4,066,259 A | | 1/1978 | Brentham | |
| 4,180,261 A | | 12/1979 | Kolka | |
| 4,185,818 A | | 1/1980 | Brentham | |
| 4,195,834 A | | 4/1980 | Lambert, Jr. | |
| 4,200,279 A | | 4/1980 | Lambert, Jr. | |
| 4,226,415 A | | 10/1980 | Wright | |
| 4,227,689 A | | 10/1980 | Keiser | |
| 4,240,627 A | | 12/1980 | Brentham | |
| 4,247,098 A | | 1/1981 | Brentham | |
| 4,254,949 A | | 3/1981 | Brentham | |
| 4,257,593 A | | 3/1981 | Keiser | |

(List continued on next page.)

FOREIGN PATENT DOCUMENTS

WO WO 95/22377 A1 * 8/1995 ..... A63B/23/04

OTHER PUBLICATIONS

Yessis, M, Sport–Specific Strength Training for Running Speed, Scholastic Coach, Jefferson City, Feb. 1992, vol. 61, No. 7, pp. 29–30.*

(List continued on next page.)

*Primary Examiner*—Nicholas D. Lucchesi
*Assistant Examiner*—Victor Hwang
(74) *Attorney, Agent, or Firm*—Faegre & Benson LLP

(57) ABSTRACT

A training method and apparatus for athletes that separates running into vertical and horizontal components. The athlete is positioned on a horizontal component training device in an upright position. The athlete contacts the horizontal component training device at a leg pad, a mid-torso location, and an upper torso location. The athlete sequentially trains for acceleration at least the hip flexor and the hip extensor muscles of each leg supramaximally against the leg pad through a sports specific motion. The athlete also sequentially trains the stretch-shortening cycle of at least the hip flexor and the hip extensor muscles of each leg supramaximally against the leg pad through a sports specific motion to train the stretch shortening component of hip flexion and hip extension. Training for acceleration is preferably against hydraulic resistance and training the stretch-shortening cycle is preferably against isotonic resistance. Next, the athlete is positioned on a vertical component training device comprising a treadmill and a stabilizing frame. The athlete is attached to the stabilizing frame. A vertical load is applied onto the athlete, either directly or indirectly through the stabilizing frame. The quadriceps and calf muscles of the athlete are supramaximally trained on the treadmill using a sports specific motion.

14 Claims, 8 Drawing Sheets

U.S. PATENT DOCUMENTS 4,258,913 A 3/1981 Brentham
4,278,249 A 7/1981 Forrest
4,291,787 A 9/1981 Brentham
4,303,239 A 12/1981 Walsh, Jr.
4,304,401 A 12/1981 Goodman
4,322,071 A 3/1982 Lambert, Jr. et al.
4,322,072 A 3/1982 White
4,326,707 A 4/1982 Strecker
4,355,801 A 10/1982 Thomsen
4,357,010 A 11/1982 Telle
4,358,108 A 11/1982 Voris
4,397,462 A 8/1983 Wilmarth
4,407,497 A 10/1983 Gracie
4,429,871 A 2/1984 Flechner
4,441,708 A 4/1984 Brentham
4,444,390 A 4/1984 Erickson
4,448,412 A 5/1984 Brentham
4,465,274 A 8/1984 Davenport
4,478,412 A 10/1984 Muir
4,478,414 A 10/1984 Molloy
4,482,152 A 11/1984 Wolff
4,502,681 A 3/1985 Blomqvist
4,509,746 A 4/1985 Mask
4,542,900 A 9/1985 Ray
4,546,968 A 10/1985 Silberman
4,556,216 A * 12/1985 Pitkanen ..... 482/131
4,566,692 A 1/1986 Brentham
4,569,519 A 2/1986 Mattox et al.
4,600,189 A 7/1986 Olschansky et al.
4,609,190 A 9/1986 Brentham
4,621,807 A 11/1986 Stramer
4,623,143 A 11/1986 Wuellenweber
4,632,389 A 12/1986 Moss
4,651,986 A 3/1987 Wang
D289,785 S 5/1987 Lindsey
4,667,955 A 5/1987 Giesch
4,674,160 A 6/1987 Gibson
4,676,502 A 6/1987 Mahr
4,696,469 A 9/1987 Elder
4,711,448 A 12/1987 Minkow et al.
4,725,055 A 2/1988 Skowronski
4,725,056 A 2/1988 Rehrl et al.
4,726,583 A 2/1988 Olsen et al.
4,728,101 A 3/1988 King
4,732,379 A 3/1988 Bodine-Reese et al.
4,732,380 A 3/1988 Maag
4,743,009 A * 5/1988 Beale ..... 482/54
4,757,992 A 7/1988 Heitsch et al.
D297,343 S 8/1988 Winston
D297,658 S 9/1988 Winston
4,776,587 A 10/1988 Carlson et al.
4,817,943 A 4/1989 Pipasik
4,836,536 A 6/1989 Jones
4,838,548 A 6/1989 Maag
4,842,271 A 6/1989 Vinciguerra
4,846,466 A 7/1989 Stima, III
4,848,739 A 7/1989 Schaub et al.
D302,713 S 8/1989 Brentham
4,863,161 A 9/1989 Telle
4,883,269 A 11/1989 Shaver
4,911,434 A 3/1990 Herring
4,919,418 A 4/1990 Miller
4,944,509 A 7/1990 Snider
4,948,122 A 8/1990 Andrews, Sr.
4,953,856 A 9/1990 Fox, III
4,979,734 A 12/1990 Sims
4,988,095 A 1/1991 Ferrari
4,997,183 A 3/1991 Winston
5,000,440 A 3/1991 Lynch
5,010,596 A 4/1991 Brown et al.
5,020,795 A 6/1991 Airy et al.
5,033,117 A 7/1991 Fairweather
5,050,589 A 9/1991 Engle
5,058,887 A 10/1991 Patterson
D321,387 S 11/1991 Jones
D321,389 S 11/1991 Jones
D321,391 S 11/1991 Jones
5,066,003 A 11/1991 Jones
5,066,004 A 11/1991 Jones
5,067,708 A 11/1991 Oschansky et al.
5,102,123 A 4/1992 Roark
5,104,119 A 4/1992 Lynch
5,110,117 A 5/1992 Fisher et al.
5,116,296 A 5/1992 Watkins et al.
5,118,100 A 6/1992 Sungaila
5,133,339 A * 7/1992 Whalen et al. ..... 601/23
5,144,694 A 9/1992 Conrad Da oud et al.
5,158,520 A 10/1992 Lemke et al.
5,167,600 A 12/1992 Baird
5,167,601 A 12/1992 Frappier
5,171,196 A 12/1992 Lynch
5,171,200 A 12/1992 Jones
5,176,597 A 1/1993 Bryne
5,180,353 A 1/1993 Snyderman
5,180,354 A 1/1993 Jones
5,211,615 A 5/1993 Sides
5,222,580 A 6/1993 Wang
5,234,392 A * 8/1993 Clark ..... 482/54
5,242,339 A * 9/1993 Thornton ..... 482/8
5,250,015 A 10/1993 Thorton
5,256,125 A 10/1993 Jones
5,273,508 A 12/1993 Jones
5,299,999 A 4/1994 Brine
5,308,304 A 5/1994 Habing
5,336,138 A 8/1994 Arjawat
5,338,274 A 8/1994 Jones
5,350,345 A 9/1994 Frey
5,352,185 A 10/1994 Blauth et al.
5,354,252 A 10/1994 Habing
5,358,468 A 10/1994 Longo et al.
5,362,297 A 11/1994 Muir
5,395,295 A 3/1995 Ish, III
5,468,202 A 11/1995 Habing
5,472,398 A 12/1995 Silverman
D365,928 S 1/1996 Sauer
5,499,962 A 3/1996 Jones
5,507,707 A 4/1996 Miller
5,509,894 A 4/1996 Mason et al.
5,512,029 A * 4/1996 Barnard et al. ..... 482/129
5,514,056 A 5/1996 Ronca et al.
5,527,251 A 6/1996 Davis
5,554,084 A 9/1996 Jones
D375,823 S 11/1996 Bleiweis
5,588,940 A 12/1996 Price et al.
5,595,556 A 1/1997 Dalebout et al.
5,685,810 A * 11/1997 Chung ..... 482/112
5,725,461 A 3/1998 Bogard, II
5,803,882 A 9/1998 Habing et al.
5,846,169 A 12/1998 Tscheschlog
5,868,652 A 2/1999 Spletzer
5,897,467 A 4/1999 Habing et al.
5,931,767 A 8/1999 Morales
5,937,441 A 8/1999 Raines
D419,624 S 1/2000 Eckmann
6,264,584 B1 * 7/2001 Bass ..... 482/54
6,482,128 B1 * 11/2002 Michalow ..... 482/14
6,666,801 B1 * 12/2003 Michalow ..... 482/137

OTHER PUBLICATIONS

Ross, WL and deRosa, NFH, Sprinting: Things to Come, Scholastic Coach, Jefferson City, Mar. 1994, vol. 63, No. 8, pp. 28–31.*
Darden, E, Nautilus Routines for Selected Sports, The Nautilus Handbook for Young Athletes, Wanderer Books, Simon & Schuster, New York, 1984, pp. 97–99.*
Body Masters Brochure, Mastering the Art of Fitness, 4 pgs.
New Flex Fitness Systems Brochure, 2 pgs.
Hammer Strength Catalog, A Life Fitness Company, 1998, 24 pgs.
Air Keiser, Equipment Specifications, Accessories and Additional Features, 4 pgs.
King Fitness Catalog, Professional Strength Equipment, 6 pgs.
Life Fitness Catalog, Perfects Heavy Metal, 1995, 19 pgs.
Magnum Fitness Systems Catalog, Made for the World, 48 pgs.
Nautilus Catalog, So Much More Than Just Iron & Steel, 1999, 20 pgs.
Paramount Catalog, Advanced Rotary Technology Performance Line, 1997, 34 pgs.
StairMaster Catalog, Expand the Envelope, 1999, 58 pgs.
Streamline Fitness Equipment, Inc. Brochure, Let Us Strengthen Your Image, 6 pgs.
STRIVE Product Preview Catalog, The Link Between a Fit Body and a Fit Business, 8 pgs.
VR Line New Product Brochure, Cybex Strength Systems, 1997.

* cited by examiner

RUN SPECIFIC TRAINING APPARATUS

The present application is a divisional application of, and claims priority to, pending U.S. patent application, Ser. No. 09/435,220, entitled RUN SPECIFIC TRAINING METHOD AND APPARATUS, filed on Nov. 5, 1999. Now U.S. Pat. No. 6,482,128 claims the benefit of prior filed provisional application serial no. 60/107,672 entitled Competitive Therapy and Exercise Equipment, filed on Nov. 6, 1998.

FIELD OF THE INVENTION

The present invention is directed to a method and apparatus for improving race times for runner, and in particular, for the well-trained athlete whose performance has plateaued. The method and apparatus generally involves separating the act of running into horizontal and vertical components and training each component using sports specific, supra-maximal techniques designed to achieve both maximum acceleration and a minimum stretch-shortening cycle.

BACKGROUND OF THE INVENTION

How fast can a human being run? Human race times have seen continued improvement ever since these records have been kept. The changes from the 1940's include for example a reduction in the 100 meter time from about 10.2 seconds to about 9.84 seconds and a reduction in the 400 meter time from about 45.9 seconds to about 43.29 seconds. Obviously these improvements cannot continue indefinitely, limited by the genetic capabilities of man. How then can this trend continue?

To date, improvements in running performance are due primarily to changes in track surfaces and shoes, diet and supplements, psychological, and training techniques. The greatest potential for improvement appears to be in the area of training techniques.

By increasing intensity and duration, performance will improve up to a point. Continued training above and beyond an optimal level will produce a subsequent decline in performance due to mental and physical breakdown. This phenomenon is known as the overtraining syndrome. If an athlete is following state of the art training philosophy and methods and is training at the threshold of overtraining, performance can only improve if the training program is improved.

Since 1970, when Arthur Jones established Nautilus Corp., a multitude of exercise machines have been developed. These machines have used a wide variety of resistance mechanisms for training, including isotonic, isokinetic, pneumatic, and hydraulic resistance. Although devices have been designed for each limb/trunk muscle in the body, a biomechanically specific method and apparatus for training is not currently available for runners.

Biomechanical analysis has shown that the most important muscles causing forward progress of the body in running are the hip flexors and hip extensors. Their primary mode of contraction is acceleration and stretch shortening. Numerous hip training apparatuses are available, however, they all have their shortcomings with respect to specificity for a particular sport and supramaximal training capabilities.

Some hip exercise devices derive stability by placing the athlete in a recumbent position (lateral, prone or supine, depending on the manufacturer), as in U.S. Pat. Nos. 4,200,279, 4,247,098, 5,273,508 and Nautilus, Stairmaster and Cybex product catalogues. None of these devices train the runner in an upright position that simulates running. Moreover, all lack a fixation system adequate for isolating the desired muscles. The U.S. Pat. No. 4,200,279 patent discloses no hip flexor training capabilities. While the U.S. Pat. No. 5,273,508 patent discloses some hip flexor strengthening capabilities, it does not allow for single-leg training, nor does it isolate the hip muscle. The U.S. Pat. No. 5,273,508 patent specifically includes use of the lower back and abdominal muscles during training of the hip, and hence, does not isolate the desired muscles. Finally, this device does not train the lower hamstrings muscles, which are important for the hip extension component of running (especially in the eccentric stretch-shortening mode). The device of the U.S. Pat. No. 4,247,098 patent discloses only a two point fixation system to secure the athlete. In addition, stretch-shortening cannot be trained because there is no eccentric component in the resistance device. Although some acceleration can be trained by virtue of a hydraulic resistance device, there is no adjustable resistance mechanism as the hydraulic device is simply a "shock absorber" type of an apparatus. Finally, this device does not train the lower hamstrings muscles, which are important for hip extension (especially in the eccentric stretch-shortening mode).

Various upright hip exercising machines have been developed, such as disclosed in U.S. Pat. Nos. 4,600,189,4,621,807, 4,711,448, 4,732,379, 5,067,708, 5,308,304, 5,354,252, 5,468,202. The main limitation of the devices disclosed in the above-noted patents is that they do not adequately stabilize the trunk of the athlete to permit isolation of the target muscles. U.S. Pat. No. 4,732,379 does not disclose an upper chest, upper back or shoulder pad, and no hand grips. The devices of the U.S. Pat. No. 4,732,379 patent discloses an inadequate two-point trunk fixation. All of the other patents listed above are all purely isotonic exercisers using a weight stack, and hence can not adequately provide acceleration training. Another problem is limited vertical adjustment capabilities, which is important to properly center the hip joint during exercising for sports specific training. While the device of U.S. Pat. No. 5,067,708 discloses multiple vertical adjustments at the actuator, this device provides no trunk stability. Finally, the athlete is not able to train the lower hamstrings for hip extension with these devices.

An analysis of the biomechanics of running teaches that the best way to train for acceleration and power is with hydraulic resistance. Numerous hydraulic and pneumatic devices are available. These devices typically orient the piston rod parallel or perpendicular to the line of force production. Pneumatic devices are less preferred because the compressibility of air, as opposed to the incompressibility of liquids, gives these devices a certain bounce effect at the start of each cycle.

U.S. Pat. No. 4,357,010 (Telle) discloses a hydraulic device where the rate of movement of the bars during lifting of the weights is maintained substantially constant by an 'isokinetic device' connected between the structure and one of the beams. The Telle device uses the hydraulic device for an isokinetic (constant speed) function to control momentum of the weights and to maintain constant velocity. Constant velocity is a sub-optimal method of training for acceleration. Telle also teaches that weights are needed to control the malingering factor that may occur when training on solely isokinetic equipment. This teaching strongly suggests that the Telle device is mainly an isotonic training apparatus, where the hydraulic/isokinetic unit is used in conjunction with the weights to maintain constant velocity, but not alone.

Additionally, the hydraulic unit of Telle is not detachable. When training stretch-shortening isotonically, the inherent friction in the hydraulic unit, even if the resistance is set at zero, lessens the eccentric load and gives sub-optimal stretch-shortening training.

The vertical component of running relates to the up and down motion of the body. Downward momentum and upward propulsion of the body are controlled by the quadriceps and calf muscles acting simultaneously. In order to increase vertical loads, weight or some downward force needs to be applied to the body. One way to train this up and down motion is to perform squats. Either barbells or any one of a large number of available squat machines can be used to perform this maneuver. The motion of the legs during this maneuver is much different than when running, including rate, range of motion and proportion of force incurred by the quadriceps versus the calf muscles. For example, when performing squats, the quadriceps absorb the majority of the force leading to undertraining of the calf muscles for running. Squat training is thus not very sport specific for running.

Another technique is to run with a weighted backpack or use of any one of a number of weighted harnesses, belts or body suits. U.S. Pat. Nos. 4,674,160 and 5,158,520 disclose a waist belt attached to a cable that is attached to a weighted rack. These devices are specifically designed for squat training, which is inadequate for the present invention.

Weighted waist belts and backpack-like devices, where load is transferred to the waist, are disclosed in U.S. Pat. Nos. 3,751,031, 4,676,502, 4,944,509, 4,948,122, 5,167,600, 5,299,999 and Des. 365,928. Furthermore, weighted body suits as disclosed in U.S. Pat. No. 5,937,441 can load any part of the body, depending on where the weights are located. However, simply adding a load to the athlete increases side-to-side and back-and-forth body motion during ground contact, which decreases stability and decreases isolation of the vertical component. The athlete is forced to focus on stability, rather than training the vertical component. Additionally, the added time spent stabilizing the body at ground contact increases total ground contact time during the stance phase of running. Increased ground contact time is contrary to increasing running speed. The added weight also increases relative dependence from the calf muscles to the quadriceps, thus creating a training imbalance (the quadriceps are overtrained relative to the calf muscles). The added weight also increases the potential for injury, since the weight is not fixed in a stable manner. Finally, applying the load to the shoulder, rather than the waist, increases the potential for spine injuries.

U.S. Pat. Nos. 4,861,021 and 4,898,378 disclose a safety device that is attached to an on/off switch. If the runner falls, the motorized treadmill automatically turns off. The devices serve no weight bearing function. U.S. Pat. No. 5,176,597 discloses a race training apparatus. The support device, such as a harness or belt, encircles or supports some portion of the body of a runner on a treadmill. The purpose of this device is not to load the body with weight, but rather to unload the weight of the body to make the runner lighter.

Finally, treadmills with a weight loading frame have been developed, such as disclosed in U.S. Pat. Nos. 5,000,440, 5,104,119, 5,110,117, 5,171,196 and 5,595,556. These patents disclose treadmills with associated upper extremity exercising handles. The athlete is required to grip handles while on the treadmill. Gripping handles and carrying weight interferes with isolation and focus on the lower extremity muscles and increases ground contact time. No harness is disclosed. Moreover, the weight is not isolated to the lower extremities, but rather is carried by the upper portions of the body and distributed to the lower extremities.

SUMMARY OF THE INVENTION

The present invention is directed to a method and apparatus for separating the act of running into horizontal and vertical components and training each component using sports specific, supramaximal training techniques designed to achieve both maximum acceleration and a minimum stretch-shortening cycle.

Sport specific training or a sports specific motion refers to actually engaging in the sport or exercising in a way that mimics the motion and muscle functions, which occur during participation of a particular sport. With regard to runners, sports specific training refers to a stride appropriate for the distance of the running event or a motion that simulates the stride. Supramaximal training (or overload training) refers to exercising with loads beyond those normally incurred when engaged in the sport. Supramaximal training requires substantially complete isolation and focus on the muscle or action being trained. The stretch-shortening cycle refers to the rapid conversion of an eccentric to concentric muscle contraction (and visa versa) such as which occurs when the hip is fully flexed and then begins to extend.

Isotonic training involves moving a weight through an arc of motion. The momentum of the weight once in motion reduces the resistance. Isokinetic training involves moving a lever arm at a constant angular velocity. Resistance is only provided at the preset velocity. Consequently, both isotonic and isokinetic training are sub-optimal methods of training for strength and acceleration. Hydraulic training provides resistance at all velocities through the entire range of motion. While hydraulic training is useful for developing strength and acceleration, it is a sub-optimal methods for training the stretch-shorting cycle (the rapid conversion of an eccentric to concentric muscle contraction such as occurs when the hip is fully flexed and then begins to extend).

As used herein, isotonic resistance refers to exercising with a constant load, the simplest example being lifting weights. Due to mechanical advantage through different arcs or motion, the resistance to the user is not always constant even though the load is constant. In fact, the most common weight lifting apparatuses use variable-resistance isotonic loading. These include cable-pulley-weight stack devices, direct drive weight stack devices and plate loading systems where mechanical advantages and disadvantages are built into the systems by use of cams to provide variable resistance through the range of motion. Other examples of isotonic resistance mechanism include a weight stack with a cable and pulley mechanism, a direct drive weight stack, a plate loading device, motorized pneumatic or hydraulic resistance devices, and elastic resistance mechanisms. Hydraulic resistance refers to resistance that varies with the force applied.

Acceleration training refers to accelerating the portion of the body being trained in a sports specific motion as fast as possible in the early lift cycle and relaxing slightly on the return stroke. Although hydraulic resistance is preferred to train for acceleration, isometric, isokinetic, isotonic, pneumatic, or elastic resistance may also be used.

Stretch-shortening cycle training refers to allowing a weight to fall as rapidly as possible on the down stroke, focusing on stopping this motion when the starting position is reached, and with as much force as possible, converting the downward momentum of the weights to an upward direction. Although the stretch-shortening cycle as described herein is trained using a cable-pulley-weight stack system, it can also be trained using direct drive weight stacks, plate loading devices, motorized hydraulic/pneumatic devices and elastic devices such as rubber bands, coil springs, bending poles, and various other systems may be used.

The primary muscles which cause forward propulsion of the body are the hip flexors and hip extensors. The quadriceps and calf muscles are the primary muscles which absorb the shock that occurs at ground contact. These two sets of muscle need to be trained separately to develop maximum power (i.e. acceleration of force) and a minimum stretch-shortening cycle. The present method and apparatus optimally trains the above groups of muscles using sport specific training techniques. The hip abductors and adductors also play a part in running and can be trained using the methods and apparatus disclosed herein.

The horizontal component requires an exercise device(s) to train the hip flexor muscles and hip extension muscles. The hip flexors/extensors need to be trained one extremity at a time in an upright manner for acceleration and stretch-shortening. The optimum way to train for power and acceleration is with a hydraulic resistance device, although other resistance mechanism may be used, including isometric, isokinetic, isotonic, pneumatic, elastic, etc. The optimum to train for the stretch-shortening cycle is with isotonic resistance (such as a pulley mechanism with a plate loaded device or an elastic resistance member, a motorized resistance device, or a variety of other resistance mechanisms).

If supramaximal training of the hip muscles is required, torso stability is required. Torso stability is optimized with three point fixation system. The present three point fixation system includes an apparatus to stabilize the torso and the upper extremities in order to isolate the hip flexor and extensor muscles and an extension pad placed on the lever arm that allows bilateral training on one device through a range of motion that simulates running (which allows the user to be in an upright, rather than prone position, when exercising).

The present horizontal component training device provides resistance to train for acceleration and the stretch-shortening cycle through a range of motion that simulates running. An additional benefit of the present horizontal component training apparatus is improved hip extension and hip flexion. In one embodiment, the resistance for training acceleration is hydraulic and the resistance for training the stretch-shortening cycle is isotonic. The combination hydraulic and isotonic resistance allows a user to change from completely hydraulic or completely isotonic training or any combination of the two simultaneously.

An adjustment mechanism is provided to adjust the axis of rotation of the athletes hip to the center of the axis of rotation of the resistance mechanism, and therefore, best simulate a running motion. Electronic components can optionally be included to measure force production, rate of force production, maximum rate of limb motion, range of limb motion, time to peak force (acceleration), etc.

The hip abductors and hip adductors can also be trained using the present horizontal component training method by turning the athlete's body 90° with respect to the horizontal component training device. The three point fixation system is used, although adjustments may be necessary. The axis of rotation of the athlete's hip is preferably located in the same plane with, but perpendicular to, the axis of rotation of the resistance mechanism.

The vertical component of running includes downward momentum and upward propulsion of the body that are controlled by the quadriceps and calf muscles acting simultaneously. In order to isolate the vertical component, the horizontal component is eliminated. That is, any action that does not propel the body forward eliminates the horizontal component, such as running on a treadmill. Optimal training for better running times requires supramaximal training of these muscles. The vertical component training focuses on strength training of the calf muscles and quadriceps muscle in an up and down fashion, in unison, with the goal being to increase resistance and decrease ground contact time.

One embodiment includes the use of a treadmill, a stabilizing frame and a vertical load on the athlete. The athlete is attached to the stabilizing frame to stabilize the athlete and the vertical load. Consequently, the athlete can completely isolate and focus on the muscles being trained. The combination of weights and a treadmill strengthen the calf and quadricep muscles supramaximally during running, thereby isolating these vertical muscles. The treadmill device may optionally include a force plate. The force plate gives the athlete feedback on the total force or input force and ground contact time of his or her stride. The biofeedback that the athlete is provided allows for training to decrease ground contact time (this is important because the fastest runners have the shortest ground contact times).

In one embodiment, the invention is also directed to a system for training athletes that separates running into vertical and horizontal components. The horizontal component training device includes a pads to contact the athlete at the mid-torso and upper torso to retain the athlete in an upright position, an actuator arm with a leg pad positioned to operatively engage with the leg of the athlete through a sports specific motion, an acceleration training resistance mechanism releasably connected to the actuator arm, and a stretch-shortening training resistance mechanism releasably connected to the actuator arm. The vertical component training device comprises a treadmill, a stabilizing frame attachable to the athlete, and a vertical load on the athlete during supramaximally training of at least the quadriceps and calf muscles on the treadmill using a sports specific motion. When attached to the stabilizing frame, the weight on the athlete is stabilized and the vertical component of running is isolated. The vertical load can be applied directly to the athlete or indirectly through the stabilizing frame.

The present training method for athletes separates running into vertical and horizontal components. The athlete is positioned on a horizontal component training device in an upright position. The athlete contacts the horizontal component training device at a leg pad, mid-torso location, and upper torso location in a three point fixation system. The position of the athlete is preferably adjusted so that the axis of hip rotation is centered on the axis of rotation of the leg pad. The athlete sequentially performed acceleration training at least the hip flexor and the hip extensor muscles of each leg supramaximally against the leg pad through a sports specific motion. The athlete also sequentially performs stretch-shortening cycle training of at least the hip flexor and the hip extensor muscles of each leg supramaximally against the leg pad through a sports specific motion. Next, the athlete is positioned on a vertical component training device comprising a treadmill and a stabilizing frame. The athlete is attached to the stabilizing frame. A vertical load is applied onto the athlete. The quadriceps and calf muscles of the athlete are supramaximally trained on the treadmill using a sports specific motion.

In one embodiment, the athlete performs acceleration training against hydraulic resistance and stretch-shortening cycle training against isotonic resistance. A combination of hydraulic and/or isotonic resistance may optionally be used for the acceleration training and/or stretch-shortening cycle training. When using the horizontal component training device, the method includes progressively increasing the level of resistance.

When using the vertical component training device, the athlete is typically attached to the stabilizing frame using a stabilizing harness around the waist region. Shoulder straps may also be used. The vertical load may be applied directly to the athlete, to the stabilizing frame, or both. The load is progressively increased. For some applications, a counterweight may be attached to the stabilizing frame to reduce the vertical load on the athlete. For some applications, the speed and inclination of the treadmill is also progressively increased. The athlete runs on the treadmill, focusing on maximum leg speed, minimum ground contact time, and minimum vertical displacement. The treadmill may be either manual or motorized.

DETAILED DESCRIPTION OF THE INVENTION

Figure 1:
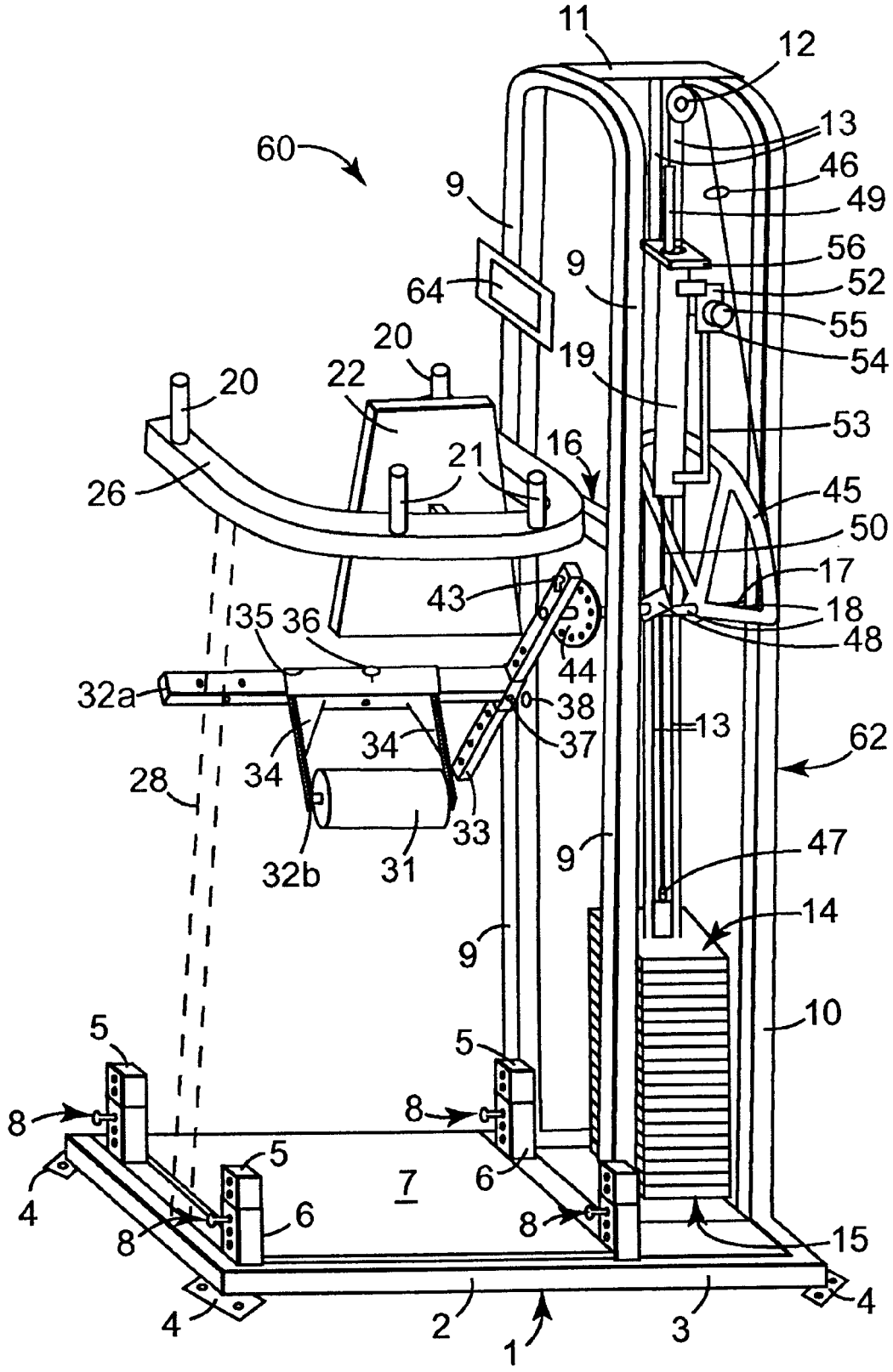
FIG. 1 is a perspective view of a horizontal component training device in accordance with the present invention.
Figure 2:
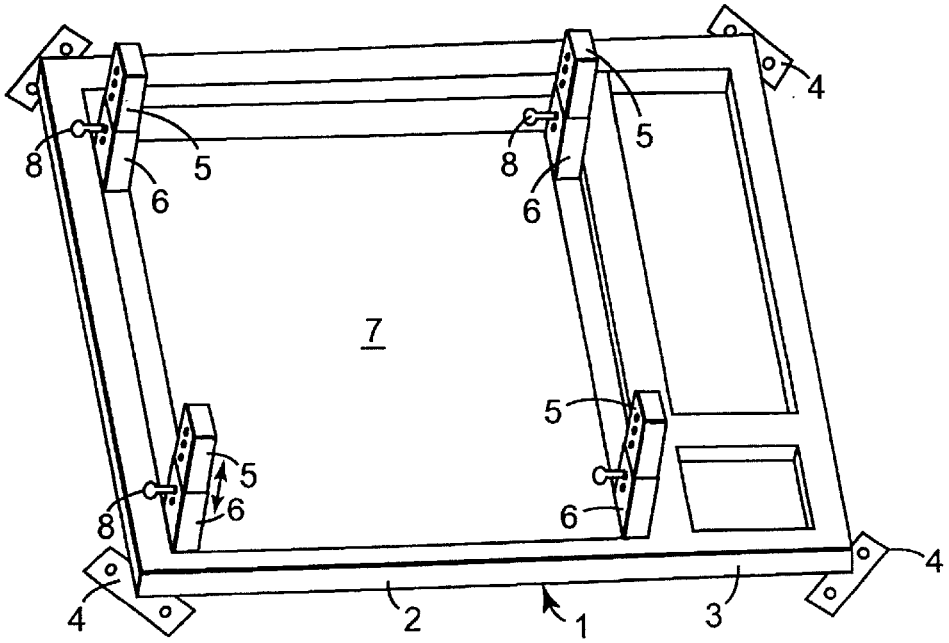
FIG. 2 is perspective view of a base frame assembly for the horizontal component training device of FIG. 1.
Figure 3:
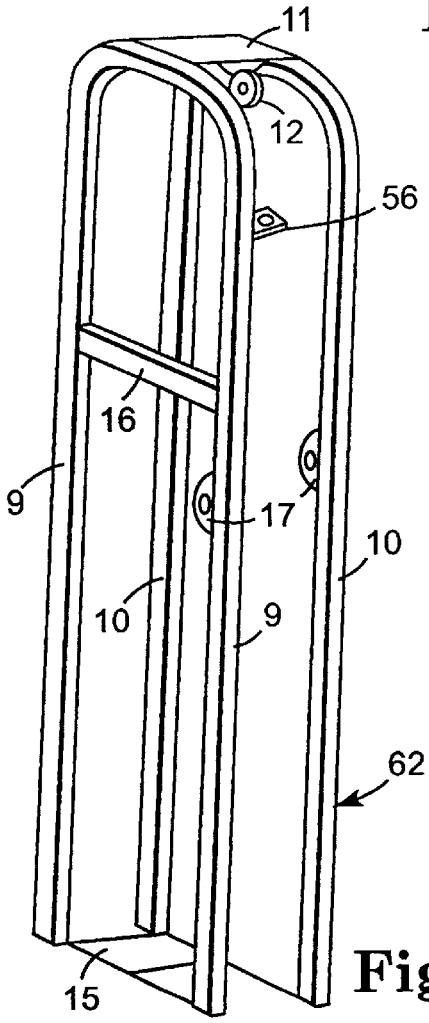
FIG. 3 is perspective view of a frame structure for the horizontal component training device of FIG. 1.
Figure 4:
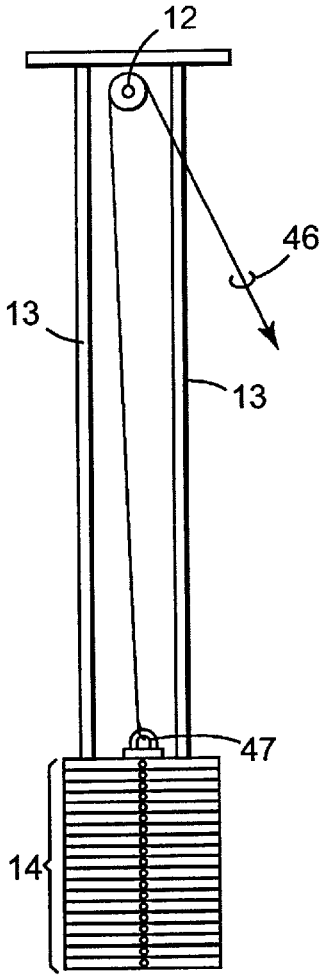
FIG. 4 is perspective view of a weight stack for the horizontal component training device of FIG. 1.

The present invention is directed to an exercise method and apparatus for runners, that when added to current training techniques will improve race times for all athletes. The present method involves breaking down the running cycle into isolated, minute components. First, the run cycle is divided into horizontal and vertical planes. Second, muscle groups that function in the horizontal and vertical components are identified. These muscles, their range and rate (acceleration, really) of motion, and mode of contraction (eccentric vs. concentric) are described.

Biomechanical analysis demonstrates that the primary muscles functioning in the horizontal component (forward propulsion) are the hip flexors (iliopsoas and rectus femoris), in association with hip extensors (gluteus maximus and hamstrings). The hip flexors in close association with the hip extensors are the major muscles which cause forward propulsion. To run faster, forward propulsion needs to be improved. Hence, the primary focus in training is placed on these muscle groups, especially the hip flexors. Due to a necessity to maintain muscle balance, the hip extensors are felt to be equally important in training.

The modes of contraction that need to be focused on for training these muscles are concentric (acceleration and power) and the eccentric-concentric conversion (stretch-shortening cycle). These two modes are of primary consideration because running is really a series of accelerations and decelerations. Concentric training for power improves forward acceleration of limbs. Training the stretch-shortening cycle gives muscles the capability of decelerating the rapid limb movement caused by the concentric contraction. Furthermore, training the stretch-shortening cycle in rapid fashion trains the muscles to absorb energy during the stretch phase in order to be released immediately in the subsequent concentric phase.

The horizontal component training device has the ability to isolate hip flexors and extensors (as well as the hip abductors and hip adductors) in the upright position while stabilizing the torso using a three point fixation system and the ability to train with either isotonic or hydraulic resistance, or both. This combination of features permits supramaximal training of the hip muscles. In the preferred embodiment, training the stretch-shortening cycle is done isotonically and training for acceleration (and power) is done using hydraulic resistance.

Muscles involved in the vertical component are the quadriceps and calf (gastrocnemius and soleus) muscles. These muscles contract in an eccentric fashion at ground contact to absorb ground reaction forces. The quadriceps are the muscles which have received the greatest amount of attention in the literature. From a biomechanic viewpoint, in the vertical plane of running, the two muscle groups (quadriceps and calf muscles) function simultaneously. If too much focus is placed on the quadriceps over the calf muscles, an imbalance will develop. For example, overtraining the quadriceps gives rise to an increased incidence of hamstrings injuries. Similarly, overtraining the quadriceps over the calf muscles gives rise to increased injuries. Since the Achilles tendon plays a significant role in force absorption and release in conjunction with the calf muscles, one cause for the relatively high incidence of Achilles injuries in sprinting (i.e. tendonitis) may be the result of overtraining the quadriceps relative to the calf muscles.

In order to understand better the present method and apparatus, two concepts defined above are stressed 1) supramaximal training and 2) sport specificity. Supramaximal training is of the utmost importance because it is the only way that a well-trained athlete can hope to improve performance. Supramaximal training involves stressing muscles which are involved in a certain activity above and beyond the demands normally placed on them during that activity. To obtain the optimal benefit from supramaximal training, muscles and/or body movements must be isolated. Only when isolated can the athlete place maximum focus on that muscle. Finally, it is well known that the acidic state which occurs intracellularly in muscles undergoing intense activity leads to impaired contracitility, hence fatigue. Supramaximal training enhances a muscle's buffering capacity, thus prolonging time to fatigue. This type of training adapts the muscle in a way that improves its ability to exercise despite low intracellular pH.

Sport specific means exercising muscles in a way that they are used during a particular activity, such that runners run, swimmers swim, etc. For runners, sports specific training refers to a stride appropriate for the distance of the event or a motion that simulates the appropriate stride. The opposite of sport specific training is crosstraining. Although there is a place for crosstraining in an athlete's overall program, crosstraining will not improve a well-trained athlete's performance in the target event. The training method of the present invention is a running specific weight training method.

Horizontal Component Training Method and Apparatus

FIGS. 1–10 illustrate one embodiment of a horizontal component training devices 60 in accordance with the present invention. The horizontal component training apparatus 60 includes a frame structure 62 having a base frame 1 with a larger section 2 and a smaller section 3. Mounting tabs 4 are located at the corners of the base frame 1 to facilitate attachment to a floor or other structure. Posts 5 are located at each corner of the larger section 2. Each post 5 includes holes for receiving a pin 8. Larger tubes 6 attached to platform 7 surround each of the corner posts 5. By sliding the tubes 6 up and down along the posts 5, the user can adjust the vertical placement of the platform 7 relative to the frame structure 62. The posts 5 preferably provide approximately 30.5 centimeters (12 inches) or more of height adjustment for the platform 7. In the preferred embodiment, the height of the platform 7 is adjusted so that the axis of rotation of the athlete's hip is centered with the axis of rotation of actuator axle 18.

The frame structure 62 also includes a pair of inverted U frame members 9, 10 attached to the corners of the smaller section 3 of the base frame 1. The U frame members 9, 10 are connected at the top by a cross bar 11 and below by the smaller section 3. The cross bar 11 also attaches two vertical poles 13 supporting weight stack 14. Base plate 15 supports the weight stack 14. The U frame member 9 has a cross bar 16 which attaches to a torso supporting member 26. Clamp 17 is attached to U frame members 9 and 10 for receiving the actuator axle 18 (see FIG. 9). The U frame member 9 also includes attachment 56 for receiving hydraulic unit 19.

Figure 5:
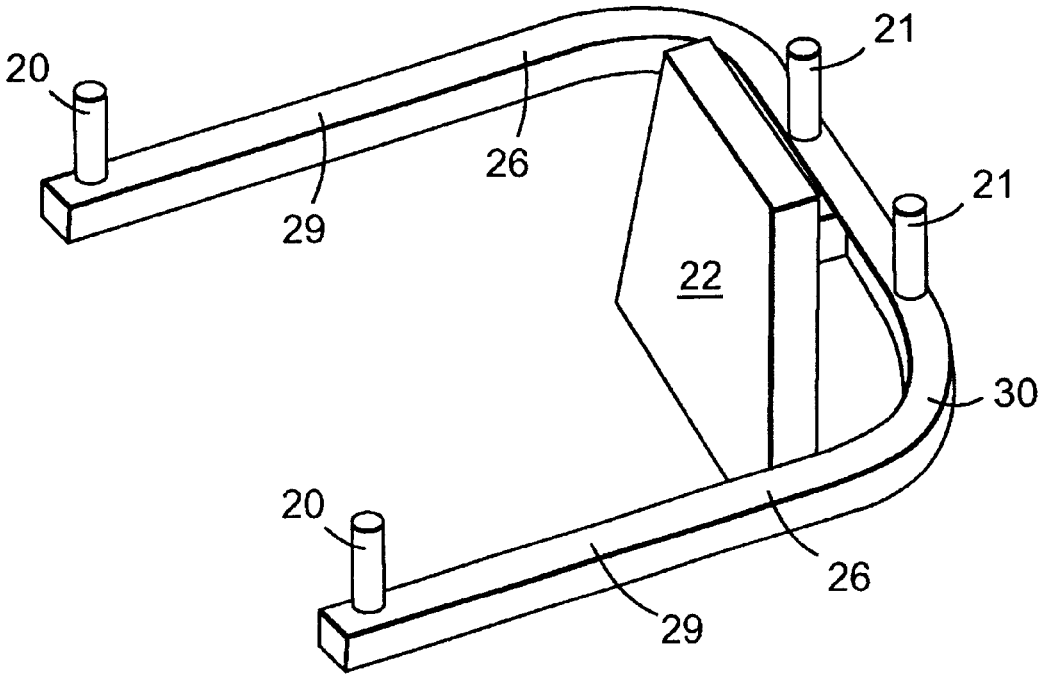
FIG. 5 is perspective view of a torso support member for the horizontal component training device of FIG. 1.
Figure 6:
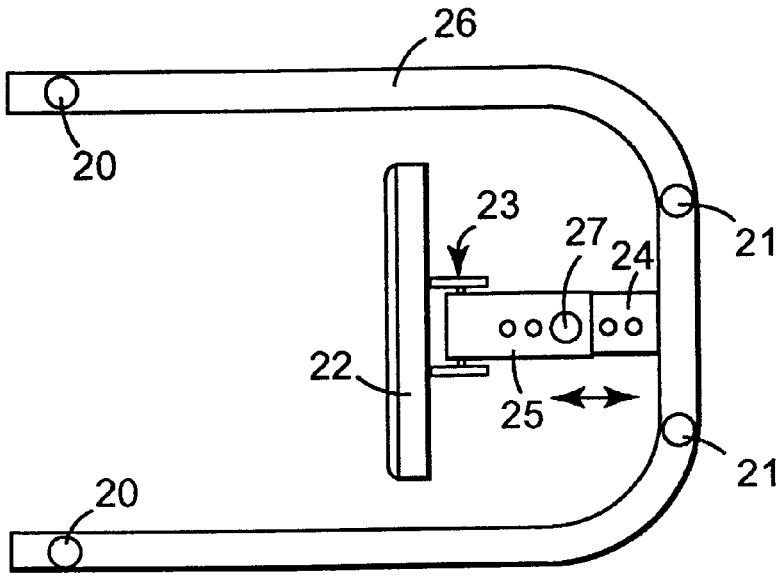
FIG. 6 is a top view of the torso support member of FIG. 5.

As best illustrated in FIGS. 5 and 6, torso supporting member 26 includes front hand grips 20 and back hand grips 21. Torso pad 22 is attached through swivel mechanism 23 to a sliding tube 24 within a tube 25. Pin 27 and hole mechanism fixes the location at which the bar is set. The adjustment mechanism permits the user to adjust the horizontal placement of the athlete relative to the apparatus. Inner tube 24 is connected to torso supporting member 26. An additional support rod 28 can optionally be attached to the free end of the torso supporting member 26. Arm pads may optionally be located at locations 29 and 30 (see FIG. 5).

The actuator arm 33 includes a crossbar 32*a* that contacts the thigh at pad 31 for either hip flexion or extension training and is also long enough for the calf to contact for hip extension training. The crossbar 32*a* has several possible variations. A device that is capable of training all four muscle groups (right and left hip flexion and hip extension) requires a long enough crossbar to contact both legs. The pad 31 has a sliding capability with pin 36 fixation at either end to stabilize it when set in place. To prevent contra-lateral leg contact at the starting point, an extension device 34 is added to the pad to place it away from the crossbar.

Figure 7:
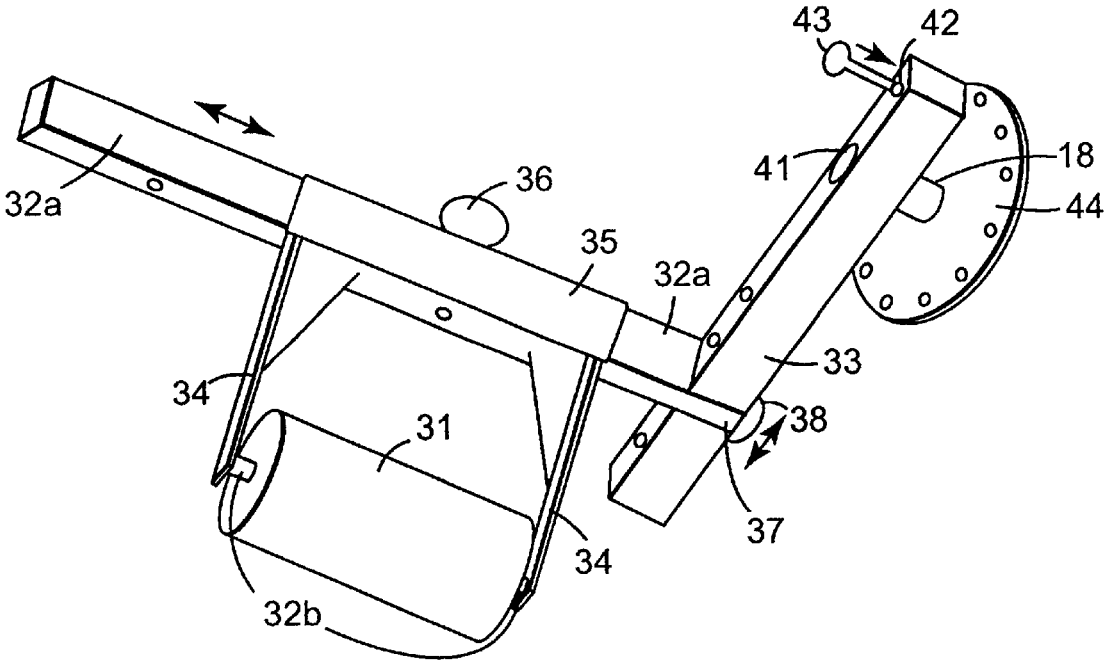
FIG. 7 is perspective view of an actuator arm assembly for the horizontal component training device of FIG. 1.
Figure 8:
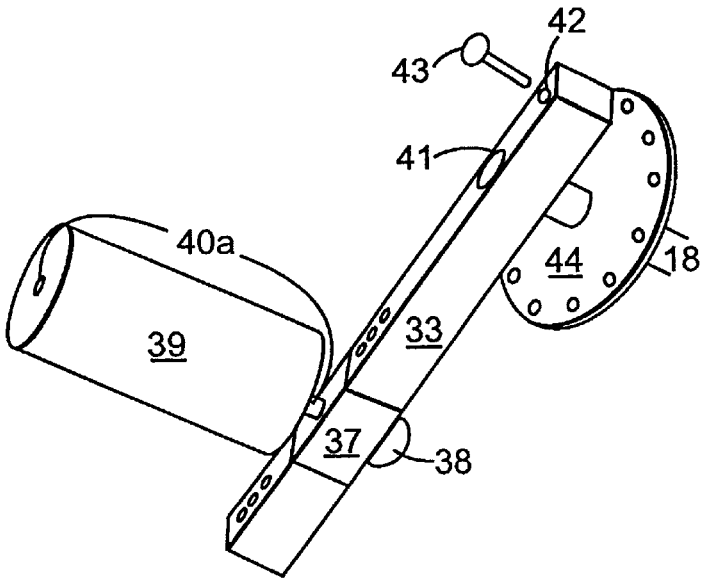
FIG. 8 is perspective view of an alternate actuator arm assembly for the horizontal component training device of FIG. 1.
Figure 9:
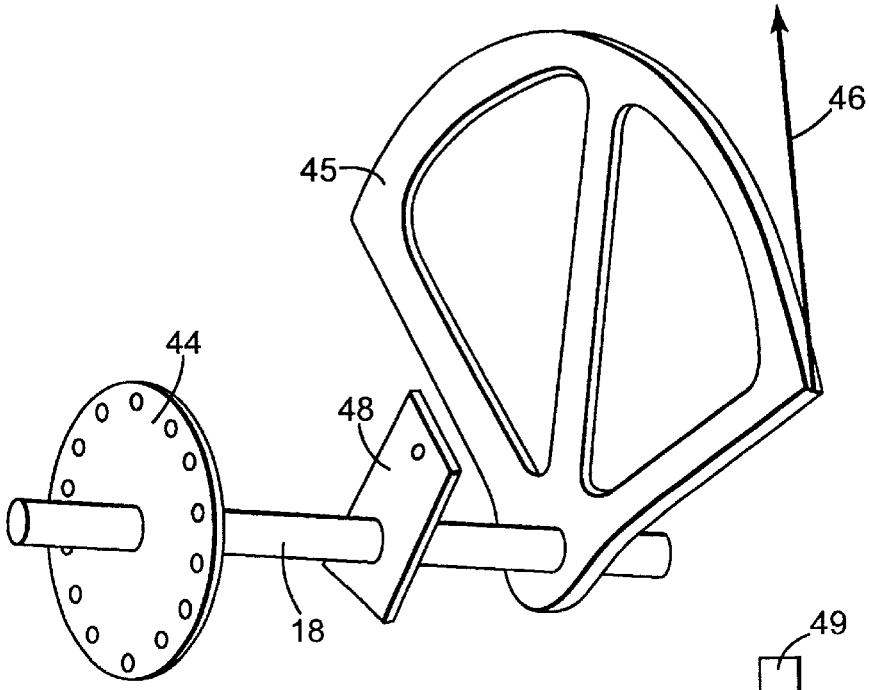
FIG. 9 is perspective view of an actuator axle for the horizontal component training device of FIG. 1.
Figure 10:
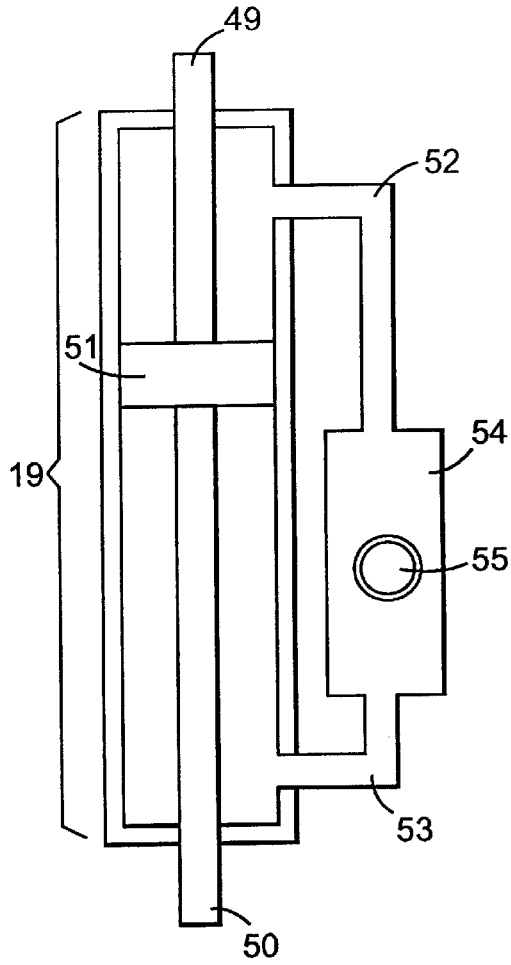
FIG. 10 is perspective view of a hydraulic unit for the horizontal component training device of FIG. 1.

FIG. 8 illustrates an alternate embodiment of the structure of FIG. 7. Pad 39 where the athlete places pressure is attached directly cross bar 40*a* without any extension bars and without sliding capabilities from right to left. The longitudinal tube 37 in tube 33 is the same as in FIG. 7. Padded crossbar 40*a* is shortened to allow only right hip flexion and left hip extension on that device. This structure obviates the need for the extension device 34 and allows a greater range of motion at the start of the lift. This structure necessitates development of a mirror-imaged base frame 1, trunk stabilizing apparatus 26 and actuator arm 33 in order to train left hip flexion and right hip extension. The mirror-image apparatus can attached to the contra-lateral apparatus as one whole unit or it may be a separate unit with its own hydraulic/isotonic mechanism. Alternatively, four separate apparatuses could be used to train the hip flexor/hip extensor for the left and right legs.

As illustrated in FIGS. 7 and 8, actuator arm 33 is connected to the actuator axle 18 at the proximal end 41. The short end of the actuator arm 33 has a hole 42 for pin 43. The actuator 44 is a disk with multiple pin placement holes. It is attached to the actuator axle 18. Pin placement fixes the actuator arm 33 at any one of a number of different starting points along the disk 44, by placing a pin through actuator arm 42 and one of the holes in disk 44. The actuator axle 18 is connected to the U shaped members 9, 10 by the clamp 17.

Actuator axle 18 includes a cam 45 connected at the distal end. The cam 45 has a cable 46 attached at one end. The cable 46 goes through the pulley 12 on the top of the U shaped members 9, 10 and then is attached to member 47 which is inserted into the weight stack 14. The cam 45 has a groove for the cable to pass on. A belt of synthetic materials, such as nylon or Kevlar, may be substituted for the cable 46. The weight stack 14 includes multiple holes for receiving a pin to select the mount of weight required for the athlete. The weights ride up and down along the poles 13 when pulled by the cable 46 due to tension supplied by the athlete when pressure is applied to the pad 31 or 39.

Lever arm 48 is also attached to the actuator axle 18. Hydraulic unit 19 is pivotally attached to U frame member 9 at attachment 56. Lower end 50 of the piston rod is pivotally attached to the lever arm 48. The lower end 50 moves through an arc during rotation of the actuator axle 18. The lower end 50 can be easily disengaged from the lever arm 48 by the athlete, using a quick release pin or other similar mechanism. The upper end 49 of the piston rod remains unattached. When the lower end of the piston rod 50 moves up and down in response to movement of the actuator axle 18, hydraulic fluid within the hydraulic unit 19 is forced from one compartment to the other compartment by pressure from the piston 51. The fluid moves between compartments via connecting tubes 52, 53. The tubes 52, 53 are separated by flow control valve 54 that is operated by knob 55. Knob 55 allows for infinite adjustment of an orifice that limits the flow rate (resistance settings) of the fluid between the compartments. The resistance provided by the hydraulic unit 19 varies with the force applied. That is, as the athlete increases the applied force, the resistance increases, and visa versa. The resistance can be set by the athlete to allow for a wide variety of training options. Alternatively, the hydraulic unit 19 can have a series of pre-set resistance settings. The double acting hydraulic unit 19 provides resistance in either one or both directions of rotation of the actuator axle 18.

The lower end 50 of the piston rod can be easily connected and disconnected from the lever arm 48. This feature gives the athlete the option of using the weight stack without the hydraulic unit 19. Alternatively, the athlete can remove the pin from the weight stack 14 and operate solely with the hydraulic unit 19. The athlete can use the hydraulic unit 19 in combination with the weight stack 14. Electronic display 64 can optionally be provided to show the time, force, range of motion, rate of motion, acceleration (time to peak force), peak rotational velocity, range at which peak velocity occurs, and other information.

The horizontal component is trained using an upright hip flexion/extension strengthening apparatus 60 that completely isolates the hip joint and completely stabilizes the torso. The apparatus 60 is capable of training these muscles in a sport specific manner (sport specific training is the optimal way to train to improve performance) in order to improve run velocity. The apparatus 60 includes a hydraulic resistance mechanism 19, which is the optimal way to train acceleration of a limb, and an isotonic training mechanism (weight stack 14), which is the optimal way to train the stretch-shortening cycle. Acceleration and stretch-shortening are the key contraction modes that the hip muscles undergo to cause forward progress of the body in running. As discussed above, other resistance mechanism can be used for training for acceleration and the stretch-shortening cycle.

In order to train supramaximally, the muscles involved must be completely isolated and the rest of the body must be completely stabilized. By completely isolating the hip joint and completely stabilizing the torso, the present apparatus 60 allows these muscles to be trained supramaximally. Supramaximal training is absolutely necessary when the goal is to optimize strength gains, especially if the athlete has plateaued. The present apparatus 60 fully stabilizes the torso in an upright fashion with a three point fixation system. The first point of fixation is contact of the thigh or calf with the pad 31 on the actuator arm 33. The second point is accomplished by a mid-torso location pad 22, which acts as a lower-back pad when training hip flexion and as a chest/abdominal pad when training hip extension. The third point of fixation is the upper torso. The upper torso is stabilized by placement of the arms out in front of the body on the upper torso supporting location 26 and gripping the front or rear hand grips 20, 21. An upper chest/shoulder/upper back stabilizing pad and/or strap may optionally be used.

For training the hip abductors and hip adductors, the athlete's body is turned 90° with respect to the horizontal component training apparatus 60. The first point of fixation is contact between the side of the thigh or calf with the pad 31 on the actuator arm 33. The second point is the side of the athlete's mid-torso against pad 22. The athlete's upper torso is stabilized by gripping one front hand grip 20 and one back hand grip 21. The athlete's arms may rest on the supporting member 26.

The athlete exercises by putting force on pad 31. The pad 31 is rotated around an axis of rotation defined by the rotation of the actuator axle 18. The athlete may train either the right or left hip by sliding the pad 31 and the tube 35 to either side of the cross bar 32*a*. Placement of the pad is fixed by the pin 36. The cross bar 32A can be moved up or down the actuator arm 33, allowing adjustment for different leg length, using tube 37 in tube 33. The position of tube 37 relative to tube 33 is set by pin 38. The axis of rotation of the athlete's hip is preferably centered along the axis of rotation of the actuator axle 18.

When using the hydraulic unit 19, a small amount of weight from the stack 14 can be used so that the actuator arm 33 returns passively, rather than the athlete having to actively return it to the starting position. When training with hydraulic resistance, the focus is on acceleration. The athlete focuses on accelerating as fast as possible in the early lift and can relax slightly on the return stroke, (which is passive when a small weight is attached to the stack).

When training isotonically, the focus is on the stretch-shortening cycle. The athlete allows the weight 14 to fall as rapidly as possible on the down stroke and focuses on stopping this motion when the starting position is reached. With as much force as possible the athlete then converts the downward momentum of the weights to an upward direction. Because stretch-shortening is being trained, once the actuator arm 33 approaches the mid-point of its roughly 90 degrees of rotation, the athlete can decrease effort which decreases force development at the end of the stroke. It should be noted that because this stretch-shortening training creates high eccentric forces, there is a possibility for injury (groin pulls, tendonitis, avulsion fractures). Thus, the athlete must perform these exercises with very slow addition of weight. Additionally, isotonic training should always be performed at the beginning of a training session, never when fatigued or after a race. Adequate warm-up, stretching and even ice cool down should be done. Close supervision is recommended.

The number of repetitions done by the athlete is determined by which race is to be run. For example, a 100 meter sprinter would perform 15–20 repetitions (a sprinter, once at full speed, takes 3–4 steps per 10 meters distance, thus each leg goes through 15–20 cycles in a 100 meter race) as rapidly as possible for both resistance mechanisms. Instead of counting repetitions, the athlete can also train based on expected time for a race. For example, a 100 meter sprinter trains as rapidly as possible for 10–12 seconds and a 400 meter sprinter trains for 50 to 60 seconds, although some pacing would be needed here.

The starting position for both training types should be varied. For hip flexion strengthening, a sprinter should concentrate on performing these exercises with relatively less total hip extension (i.e., less than zero degrees extension (zero is when the leg is completely vertical) because we know that the elite sprinter runs a race with hip range of motion of about 20 degrees to about 90 degrees. For hip extension training, the starting point should approximate 90 degrees of flexion, as this is the amount of flexion that occurs with sprinting. Also for hip extension training with both calf and thigh pad resistance should be done in order to include lower hamstrings training.

Vertical Component Training Apparatus and Method

FIGS. 11–18 illustrates a vertical component apparatus 160 in accordance with the present invention. The vertical component apparatus 160 includes a treadmill 162 and a stabilizing frame 164. In the illustrated embodiment, the treadmill 162 is manually operated. Alternatively, a motorized treadmill 162 may be used.

Figure 11:
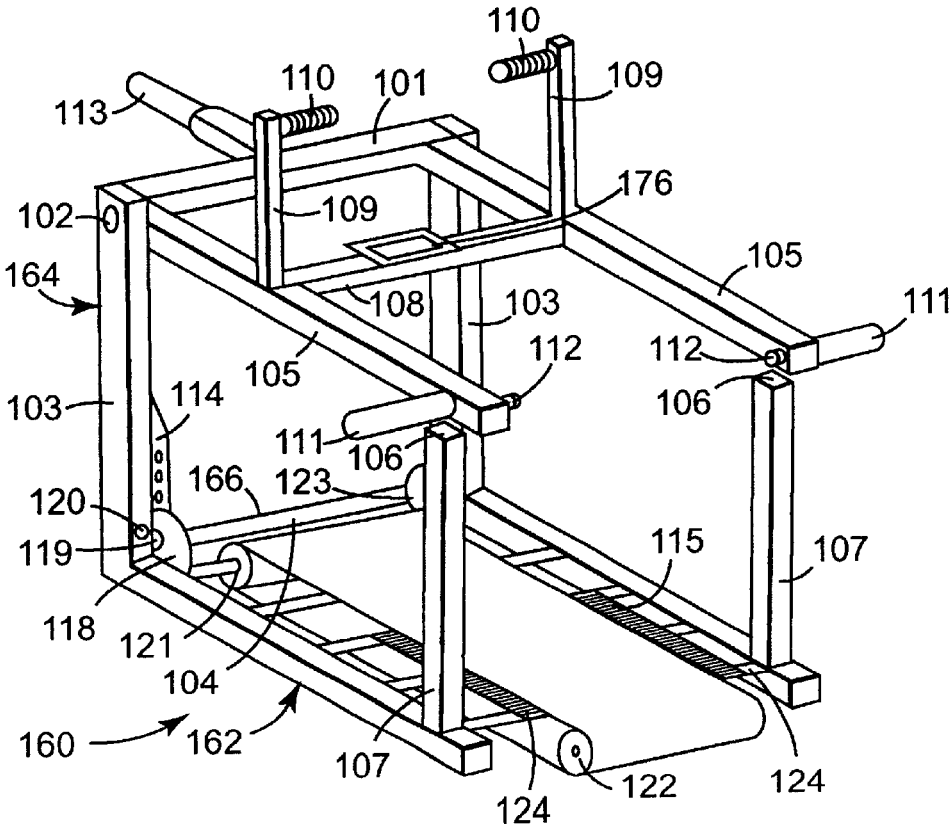
FIG. 11 is a perspective view of a vertical component training device in accordance with the present invention.
Figure 12:
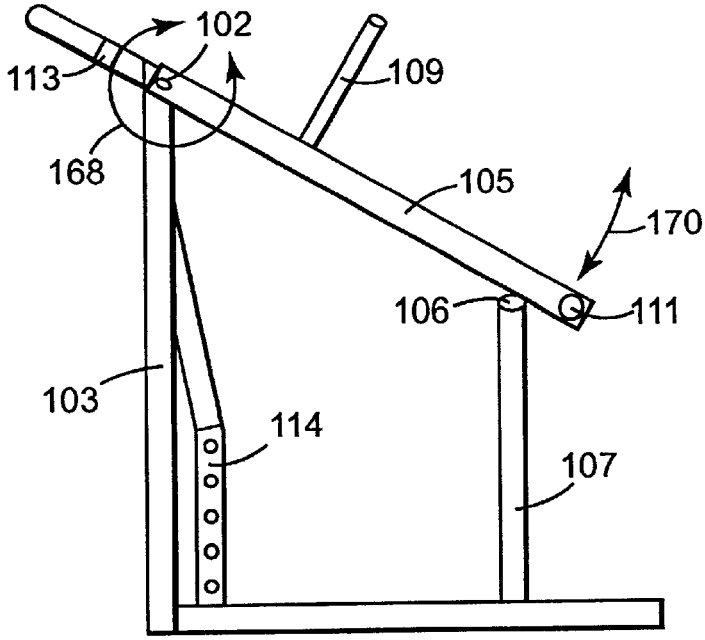
FIG. 12 is a side view of a stabilizing frame in accordance with the present invention.
Figure 13:
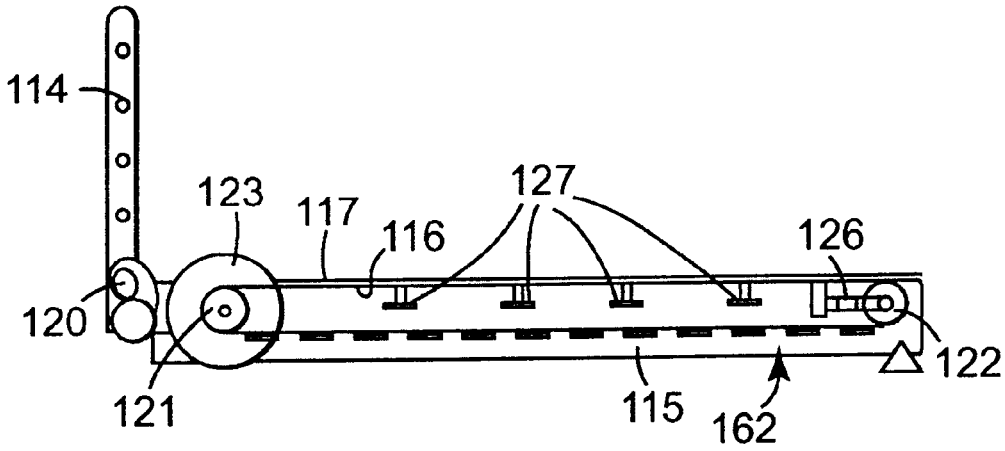
FIG. 13 is a side view of a treadmill in accordance with the present invention.
Figure 14:
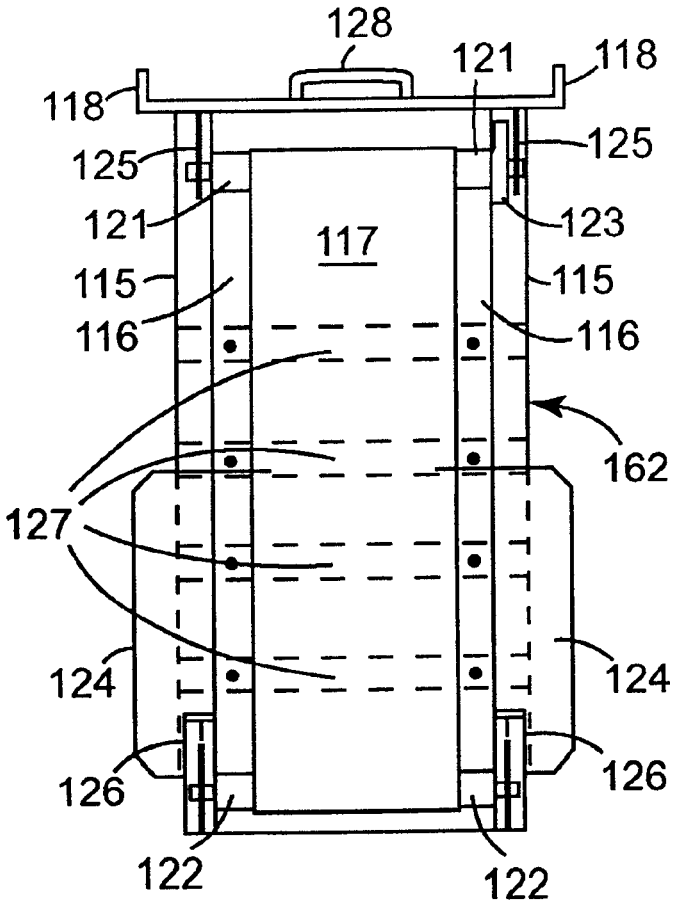
FIG. 14 is a top view of the treadmill of FIG. 13.

The stabilizing frame 164 illustrated in FIGS. 11 and 12 includes a horizontal bar 101 at the front 166 which is attached at both ends to an axle 102 for pivoting or rotation 168 in an up and down fashion 170 (see FIG. 12). The axle 102 is attached to vertical support bars 103 on both sides with an additional horizontal support bar 104 at ground level. Two longitudinal bars 105 with a slightly downward inclination from the front to back run parallel to the outer borders of the treadmill. The distal ends of the longitudinal bars 105 rests on rubber pads 106 which are supported by vertical support bars 107. Cross bar 108 attaches midway between both of the mobile longitudinal bars 105.

Each of the longitudinal bars 105 has an upwardly extending L shaped arm 109 which is attached to hand grips 110. Hand grips 110 are provided to stabilize the athlete during the beginning and end of the exercise cycle. The hand grips 110 can also be grasped if the athlete looses balance during exercise. On the inner side of the longitudinal bars 105 are attachment sites 112 for engagement with harness rings 136 (see FIGS. 15–17). An additional plate loading rod 113 is attached to horizontal bar 101 to act as a counter weight to the longitudinal bars 105.

The distal most end of the longitudinal bars 105 include rods 111 extending outwardly and at a slightly upward angle. In one embodiment, the vertical load is placed on the athlete by adding weight plates to the rods 111. In another embodiment, the athlete wears or carries the additional weight that provides the vertical load, and the stabilizing frame 164 minimizes the side-to-side and back-and-forth motion of the athlete.

The treadmill 162 includes a frame with side channels 115 running parallel on each side to platform 116. The platform 116 is made of a low friction durable surface finish on top in which a treadmill belt 117 runs. The front end of the frame has attachments 118 on both end with holes 119 for pin placement 120 that fixes the treadmill 162 at any one of several inclination settings 114. The treadmill 162 further includes a front roller 121 and back roller 122 around which the belt 117 is secured. In addition, the front roller 121 also attaches to a fly wheel 123 for momentum assistance. The location where the runner stands on the treadmill platform 116 includes a wider surface 124 for the athlete to stand on when the belt 117 is running. The wider surface 124 also is a safety mechanism for when the athlete is training and looses his or her balance.

The front roller 121 is centered by an adjustment screw on each side adjacent to the roller attachment 125. The rear roller 122 has self-adjusting springs 126. Due to the added weight of the treadmill 162, additional cross members 127 run under the platform 116 and are attached to the parallel channels 115. The additional supports 127 are needed because of the additional weight load provided by the stabilizing frame 164. A handle 128 at the front end allows for easy lifting of the treadmill for inclination adjustment.

Figure 15:
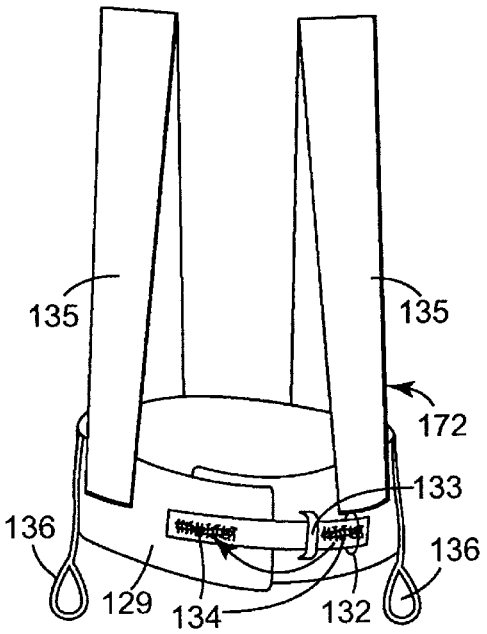
FIG. 15 is a front view of a stabilizing harness in accordance with the present invention.
Figure 16:
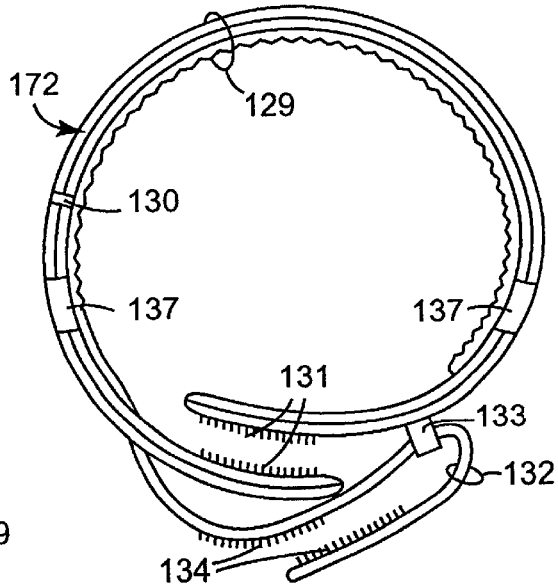
FIG. 16 is a side view of the stabilizing harness of FIG. 15.

Stabilizing harnesses 172 is illustrated in FIGS. 15–16 includes a waist belt 129 made of a strong durable material, such as heavy duty nylon or leather. In the preferred embodiment, the harness 172 is designed such that the majority of the weight is transferred to the waist of the athlete. The waist belt 129 is reinforced with an inner thick nylon liner 130. The front of the waist belt 129 has opposing hook and loop surfaces 131 and a reinforcing strap 132 which loops through buckle 133 and attaches to opposing hook and loop surface 134. Alternate belt adjustments are well within the scope of the invention. Attached to the belt 129 are shoulder straps 135 with an adjustable buckle or strap (not shown). Any number of adjustment or attachment mechanisms can fulfill the requirements of the present invention. Attached at both sides, laterally or slightly in front of the center of gravity of the athlete are loops or rings 136 for connecting to the weight frame 164 at attachment sites 112. The loops 136 are optionally reinforced within the belt 129 by members 137.

Figure 18:
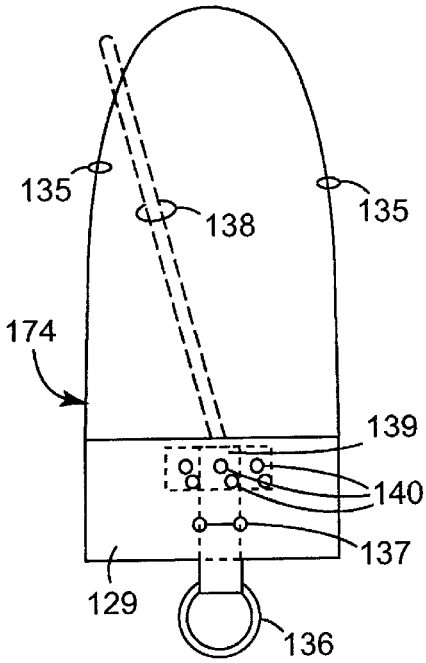
FIG. 18 is a top view of the stabilizing harness of FIG. 17.
Figure 17:
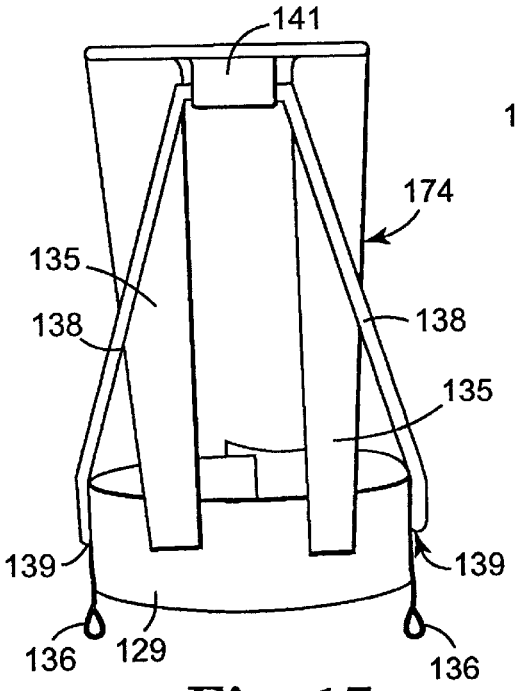
FIG. 17 is a front view of an alternate stabilizing harness in accordance with the present invention.

FIGS. 17 and 18 illustrate an alternate stabilizing harness 174 in accordance with the present invention. If a non-reinforced belt 129 is used, or if extraordinary weight is to be used, then a de-rotation frame 138 may be optionally be attached to waist belt 129. The de-rotation frame 138 is preferably metal. The derotation frame 138 minimizes rotate the top of the belt 138 outwards relative to the bottom of the belt 138, such as where the waist belt 129 that is not reinforced, or where the loop attachment 136 is in the center or upper portion of the belt, or where a relative thin (short vertical distance) belt is used. The attachment to the waist 129 is through a metal bar 139 within the waist belt 129, reinforced by rivets 140. At the upper end, a strap 141 attaches to the metal bar 139 to the shoulder straps 135.

The stabilizing frame 164 isolates and stabilizes the quadriceps and calf muscles in the vertical plane thereby training these muscles simultaneously to maintain balance. The vertical load on the athlete allows for supramaximal eccentric training of the quadriceps/calf muscles and allows for gradual progression of training, which is necessary to avoid injuries (high eccentric forces with rapid progression are associated with injuries). The treadmill 162 provides the runner with the ability to decrease ground contact time by minimizing knee flexion and vertical displacement. The treadmill 162 permits the vertical component to be specifically trained for any length of race, from a 50 meter sprint to a mile, or more. In an embodiment that uses a manual treadmill, the runner makes speed adjustments, rather than a motorized treadmill where the runner has to adjust to a preset speed. Electronic display 176 can optionally be provided to show the time, force, range of motion, rate of motion, ground contact time, acceleration (time to peak force), peak rotational velocity, range at which peak velocity occurs, and others.

The stabilizing frame 164 is preferably anchored to the ground and/or treadmill 162. The stabilizing frame 164 allows only one degrees of freedom in the direction 168 around the axis 102. If the athlete is running on the treadmill 162 and is attached to the stabilizing frame 164 (as discussed below), side-to-side and back-and-forth motion of the athlete is minimized. The vertical component of running is thus isolated on a treadmill 162, such that the athlete can now place full focus and energy into the up and down movement of the body (optimal supramaximal training requirements are met). Furthermore, since less time is spent stabilizing the body, total ground contact time is decreased.

The vertical component of running relates to the up and down motion of the body. Downward momentum and upward propulsion of the body are controlled by the quadriceps and calf muscles acting simultaneously. Optimal training for better run times requires supramaximal training of these muscles. Supramaximal training (or overload training) requires exercising with loads beyond those normally incurred when engaged in the sport. Supramaximal training also requires substantially complete isolation and focus on the muscle or action being trained. It is not possible to achieving optimum supramaximal training simply by running.

The present apparatus 160 trains the vertical component of running in a sports specific manner with supramaximal training capabilities in order to improve run performance. The athlete runs on the treadmill, moving his legs as rapidly as possible, which serves to train the quads and calf muscles simultaneously, while "teaching" them to decrease ground contact time. Vertical displacement of the athlete (unnecessary up and down body motion) during running is also minimized. It is preferable, especially for sprinters, to make contact only with the forefoot (no heel contact). Since this method subjects the athlete to high eccentric forces (eccentric forces are the ones that cause injury) it is best to first use the device with no added weight in order to teach the athlete proper form before weights are added.

Since injuries such as tendonitis, muscle strains, stress fractures, are possible it is recommended that the weight load and the time spent for each repetition. A repetition is the amount of time spent on the apparatus before resting, such that it could be anywhere from 5 to 10 to 100 steps or more, be increased very slowly. In addition, sufficient time between repetitions is needed along with at least one to two days rest between training sessions on the apparatus 160. Appropriate warm-up and stretch is mandatory. Coaching supervision is recommended. The apparatus 160 should be used at the beginning of a training session, but typically not at the end of the session and not when fatigued or after a competitive race.

The time spent on the apparatus 160 is determined by the length of the race for which the athlete is training. For example, a sprinter training for the 100 meter sprint should move his legs as rapidly as possible for 10–12 second repetitions. A 400 meter sprinter will do the same for 50–60 second repetitions, and so on. Rest in between repetitions and amount of weight has to be determined individually, as for any weight training program. Timing of the sets could be done by a coach or trainer with a stop watch. An electronic timer mounted on the treadmill with a display, as is common for many currently available treadmills, could also be used.

EXAMPLES

Adaptation of Method and Apparatus for Specific Distances

The method and apparatus of the present invention can be adapted to various distances. A 400 meter sprint is described below.

The runner uses the machine the same way that running drills are performed. Instead of running a series of 400 meter sprints or intervals, the athlete trains each lower muscle as if it was running 400 meter or doing intervals for a 400 meter pace (i.e. 4 sets of 100 m sprints). The hip muscle, for example, would be trained for 50–60 seconds with short rest periods just as the running drills. This training is followed by the opposite hip flexors and hip extensor exercises.

With an acceleration training resistance mechanism, the athlete focuses on flexing the hip forward as rapidly as possible from about 0°–20° flexion to greater than about 90° flexion. The resistance is at a relatively low setting to allow acceleration training. These exercises are concentric and can be performed as frequently as felt necessary, such as 2 to 3 times per week.

Next, using a stretch-shortening cycle training resistance mechanism, the athlete focuses on the stretch-shortening cycle aspect of hip rotation. That is, the conversion from extension to flexion, and visa versa. The conversion should be performed as rapidly as possible. Just as with acceleration training, the number of repetitions is determined by the type of sets that are being done that day. Since eccentric forces can be high with this type of exercise, this portion of the training program must be started out carefully and progressed very gradually. These exercises should be done about 2 times per week, certainly not more than 3 times per week.

The vertical training method is also a high eccentric force producing technique. At the beginning, the athlete should familiarize himself with the harness and begin running in place on the treadmill with no added weight, but with the harness attached. As the athlete becomes comfortable with running with an attached harness, the focus shifts to decreasing ground contact time and minimizing knee flexion and vertical leap. Over time, there should be a very gradual increase in added weight. Just as with the horizontal training, the length of time spent on the treadmill depends on the types of sets that need to be done based on the length of the race. This type of training should be done no more than 2 times per week. In addition, this training should be done at the beginning of the day's routine so as not to subject the athlete to high eccentric forces when he or she is fatigued, such as towards the end of a practice.

Although the present invention has been described with reference to preferred embodiments, workers skilled in the art will recognize that changes may be made in form and detail without departing from the spirit and scope of the invention. In addition, the invention is not to be taken as limited to all of the details thereof as modifications and variations thereof may be made without departing from the spirit or scope of the invention.

What is claimed is:

1. A system for training athletes that separates running into vertical and horizontal components, comprising:

a horizontal component training device having a mid-torso pad and an upper torso pad to retain the athlete in an upright isolate at least hip flexor and hip extensor muscles of each leg, the upper torso pad located at least as high as a thorax of the athelete, an actuator arm and leg pad positioned to operatively engage with the leg of the athlete during movement through a sports specific motion, an acceleration training resistance mechanism releasably connected to the actuator arm, and a stretch-shortening cycle resistance mechanism releasably connected to the actuator arm; and a vertical component training device comprising a treadmill, a stabilizing frame attachable to the athlete, to isolate at least quadriceps and calf muscles of each leg, and a vertical load on the athlete during supra-maximally training of at least the quadriceps and calf muscles adapted to be applied onto treadmill using a sports specific motion to decrease ground contact time.

2. The system of claim 1 wherein the acceleration training resistance mechanism comprises a hydraulic resistance mechanism.

3. The system of claim 2 comprising a lever arm connecting the hydraulic resistance mechanism to an actuator arm axle.

4. The system o f claim 1 wherein the stretch-shortening cycle resistance mechanism comprises an isotonic resistance mechanism.

5. The system of claim 4 wherein the isotonic resistance mechanism comprises a weight stack.

6. The system of claim 1 comprising a stabilizing harness configured to attach to a waist of the athlete, the stabilizing harness having attachment mechanisms attachable to the stabilizing frame.

7. The system of claim 6 wherein the stabilizing harness includes shoulder straps.

8. The system of claim 1 wherein the stabilizing frame applies the vertical load to the athlete during supramaximal training on the treadmill.

9. The system of claim 1 wherein the vertical load comprises weights attached to the stabilizing frame.

10. The system of claim 1 where in the vertical load comprises weights attached to the athlete.

11. The system of claim 1 comprising a counter-weight on the stabilizing frame positioned to reduce the vertical load on the athlete.

12. The system of claim 1 wherein the stabilizing frame is attached to the treadmill.

13. The system of claim 1 wherein the treadmill comprises a motorized treadmill.

14. The system of claim 1 including a display capable of displaying one of force, peak force, acceleration, range of motion, rate of motion, repetitions, and ground contact time.

* * * * *